US007295167B2

(12) United States Patent
Aminzadeh et al.

(10) Patent No.: US 7,295,167 B2
(45) **Date of Patent: *Nov. 13, 2007**

(54) ANTENNA MODULE

(75) Inventors: Mehran Aminzadeh, Braunschweig (DE); Meinolf Schafmeister, Hildesheim (DE); Florian Scherbel, Hildesheim (DE); Keno Mennenga, Braunschweig (DE)

(73) Assignee: Receptec GmbH, Hildesheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/753,539

(22) Filed: May 24, 2007

(65) Prior Publication Data

US 2007/0210967 A1 Sep. 13, 2007

Related U.S. Application Data

(63) Continuation of application No. 11/494,533, filed on Jul. 28, 2006, which is a continuation of application No. 11/185,015, filed on Jul. 20, 2005, now abandoned.

(30) Foreign Application Priority Data

Jul. 20, 2004 (DE) ..... 10 2004 035 064

(51) Int. Cl.
*H01Q 1/32* (2006.01)
*H01Q 1/38* (2006.01)

(52) U.S. Cl. ..... 343/713; 343/700 MS; 343/846

(58) Field of Classification Search ..... 343/700 MS, 343/713, 846

See application file for complete search history.

(56) References Cited

U.S. PATENT DOCUMENTS 4,089,003 A * 5/1978 Conroy ..... 343/700 MS
4,218,682 A 8/1980 Yu (Continued)

FOREIGN PATENT DOCUMENTS

DE 101 33 295 1/2003

(Continued)

OTHER PUBLICATIONS

Dual-Frequency Patch Antennas, Maci, S. Gentili, G.B., IEEE Antennas and Propagation Magazine, Bd. 39, Nr 6, Dec. 1997, pp. 13-20.

(Continued)

*Primary Examiner*—Tan Ho
(74) *Attorney, Agent, or Firm*—Harness, Dickey & Pierce, P.L.C.

(57) ABSTRACT

Exemplary embodiments are provided of antenna modules for frequencies in the GHz range and that may be mountable on a motor vehicle. In various exemplary embodiments, an antenna module generally includes upper and low patch-antennas on respective upper and lower substrates. Each patch-antenna includes λ/2-antenna structure provided on the upper surface of the respective upper or lower substrate for reception of satellite-transmitted frequencies in the GHz range. A metallization is also provided on or in contact with the lower surfaces of the upper and lower substrates. A lower antenna connector runs from the lower λ/2-antenna structure through the lower substrate. An upper antenna connector, separate from the lower antenna connector, runs from the upper antenna structure through the upper substrate and the lower patch-antenna.

20 Claims, 4 Drawing Sheets

U.S. PATENT DOCUMENTS

| | | | | |
|---|---|---|---|---|
| 4,401,988 | A | 8/1983 | Kaloi | |
| 4,827,271 | A | 5/1989 | Berneking et al. | |
| 5,003,318 | A | 3/1991 | Berneking et al. | |
| 5,121,127 | A | 6/1992 | Toriyama | |
| 6,087,990 | A | 7/2000 | Thill et al. | |
| 6,118,406 | A | 9/2000 | Josypenko | |
| 6,329,959 | B1 | 12/2001 | Varadan et al. | |
| 6,639,558 | B2 | 10/2003 | Kellerman et al. | |
| 6,762,729 | B2 | 7/2004 | Egashira | |
| 6,850,191 | B1 | 2/2005 | Thill et al. | |
| 6,930,639 | B2 * | 8/2005 | Bauregger et al. | 343/700 MS |
| 7,030,824 | B1 * | 4/2006 | Taft et al. | 343/767 |
| 7,084,815 | B2 * | 8/2006 | Phillips et al. | 343/700 MS |
| 7,202,818 | B2 | 4/2007 | Anguera Pros et al. | |
| 2003/0052825 | A1 | 3/2003 | Rao et al. | |
| 2004/0051661 | A1 | 3/2004 | Wixforth et al. | |
| 2004/0090367 | A1 | 5/2004 | Montgomery et al. | |
| 2006/0097924 | A1 | 5/2006 | Yegin et al. | |
| 2006/0273969 | A1 * | 12/2006 | Aminzadeh et al. | 343/713 |

FOREIGN PATENT DOCUMENTS

| | | |
|---|---|---|
| EP | 0 188 087 | 7/1988 |
| EP | 0 521 384 | 1/1993 |
| EP | 1 249 892 | 10/2002 |

OTHER PUBLICATIONS

Handbook of Micropstrip Antennas, Authors: James, Jim R.; Hall, Peter S; Handbook of Microstrip Antennas, 1989, pp. 318-320.

Build This No-Tune Dual-Band Feed for Mode L/S, The Armstrong Journal, Jan./Feb. 2002, 7 pages.

Multi-Layer Parasitic Microstrip Array Antenna on LTCC Substrate for Millimeter-Wave System-on-Package, Seki, T. Nishikawa, K. Cho, K., NTT Network Innovation Lab., NTT Corp., Kanagaway, Japan; 33rd Microwave Conference, 2003, vol. 3, pp. 1393-1396.

Half-Wave Stacked Patch Antenna With Dielectric Feed, Voipio, V. Ollikainne, J. Vainikainen, P., IRC Radio Lab., Helsinki University of Technology, Espoo; Antennas and Propagation Society International Symposium, 1999. IEEE Publication Date: Aug. 1999, vol. 4, pp. 2466-2469.

Novel Probe-Feeding Architectures for Stacked Micropstrip Patch Antennas, Novel Probe-Feeding Architectures for Stacked Microstrip Patch Antennas, Kona, K.S., Rahmat-Samii, Y., Dept. of Electrical Engineering, California University, Los Angeles, CA, USA, Microwave and Optical Technology Letters, vol. 38, No. 6, pp. 467-475, Publisher: Wiley, Aug. 11, 2003.

* cited by examiner

ANTENNA MODULE

CROSS-REFERENCE TO RELATED APPLICATIONS

This application is a continuation of U.S. patent application Ser. No. 11/494,533 filed Jul. 28, 2006, which, in turn, is a continuation of U.S. patent application Ser. No. 11/185,015 filed Jul. 20, 2005 (now abandoned), which claims the priority of German Application No. DE 10 2004 035 064.7 filed Jul. 20, 2004. The disclosures of the above applications are incorporated herein by reference.

FIELD

The present disclosure relates generally to antenna modules for frequencies in the GHz-range to be affixed to a motor vehicle.

BACKGROUND

The statements in this section merely provide background information related to the present disclosure and may not constitute prior art.

An antenna module may be used for integrating various functions of vehicle roof antennas. There are known microstrip patch-antennas, which include a substrate having a lower surface with metallization of the entire area thereof and an upper surface with a suitable metallic structure or antenna structure thereon. Such microstrip-patch-antennas commonly have a very narrow frequency bandwidth, for example, one percent to two percent relative bandwidth, unless additional measures are taken. By employing parasitic elements, bandwidth may be increased or multiple frequency bands may be blocked. These parasitic elements are conduction or surface structures, which are present on the same or higher plane than that of the antenna structure. If the parasitic elements are on a higher antenna structure, then they are coupled to the lower antenna structure, wherein a common HF-connection cable on the lower antenna structure runs to an amplification unit. In the parasitic elements, high frequency currents are induced, which adapt to the shape and dimensions of the parasitic elements and thereby produce fields. As a result, the entire structure has the capacity to send and receive both neighboring as well as somewhat distantly spaced frequencies.

But antenna structures of the above-described type are only suitable if the entirely expanded frequency band is allocated for the same service. When multiple, independent services are intended, then antenna modules with separately built antenna elements arranged next to one another are then used. In this configuration, however, more space is required. Furthermore, sufficient isolation is required for the proper function of the individual antennas elements.

SUMMARY

According to various aspects, exemplary embodiments are provided of antenna modules for frequencies in the GHz range and that may be mountable on a motor vehicle. In various exemplary embodiments, an antenna module generally includes upper and low patch-antennas on respective upper and lower substrates. Each patch-antenna includes λ/2-antenna structure provided on the upper surface of the respective upper or lower substrate for reception of satellite-transmitted frequencies in the GHz range. A metallization is also provided on or in contact with the lower surfaces of the upper and lower substrates. A lower antenna connector runs from the lower λ/2-antenna structure through the lower substrate. An upper antenna connector, separate from the lower antenna connector, runs from the upper antenna structure through the upper substrate and the lower patch-antenna. In some embodiments, the connecting of the lower antenna connector to the lower λ/2-antenna structure may be substantially free from being covered by the upper substrate. In some embodiments, the upper and lower patch-antennas may each have a radiation pattern covering an elevation angle from about thirty degrees to about ninety degrees. In some embodiments, the upper patch-antenna may share the same common ground plane with the lower patch-antenna without an interlayer galvanic connection therebetween such that a signal from the upper patch-antenna will carry through the lower substrate.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 3:
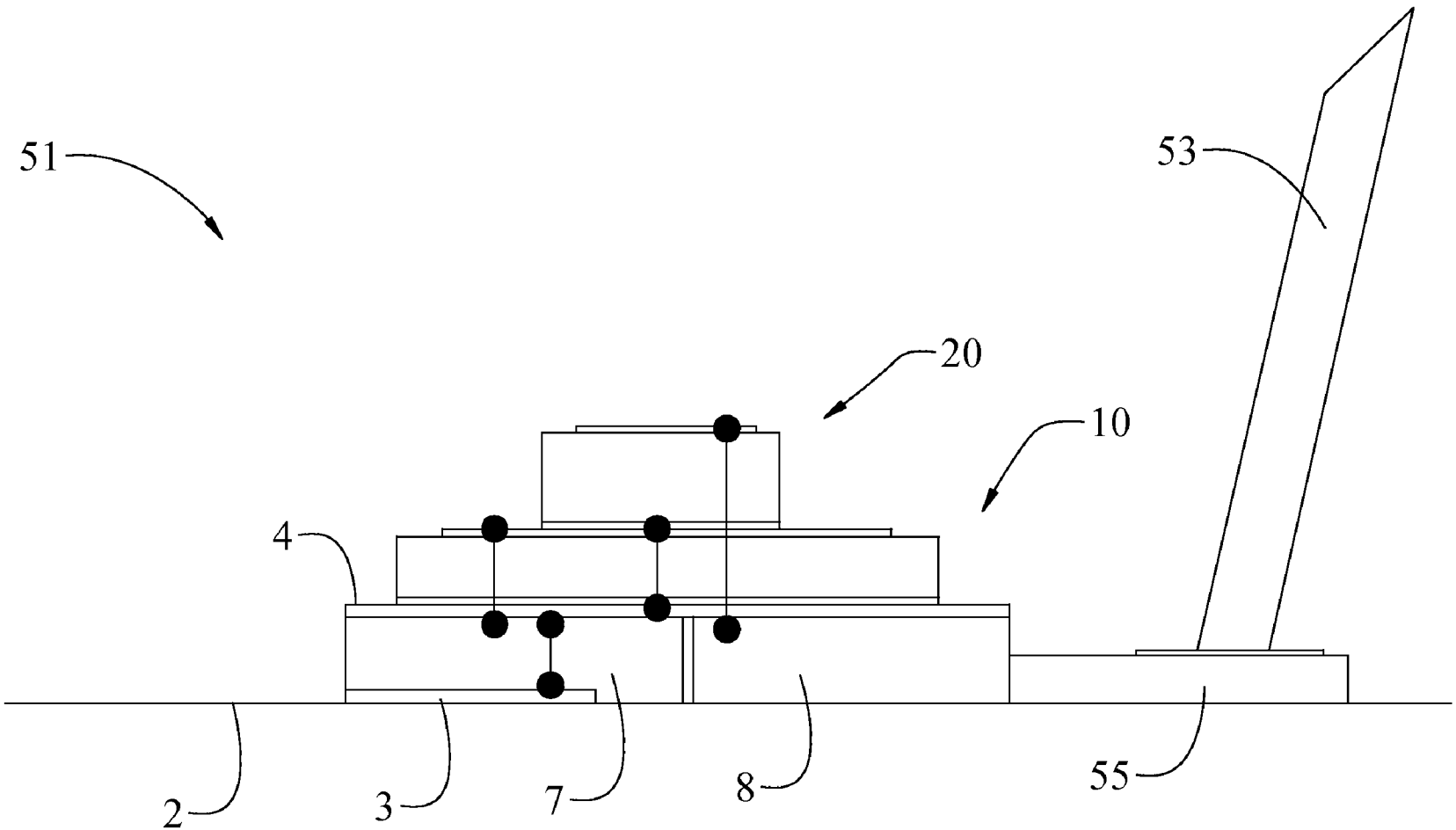
Figure 4:
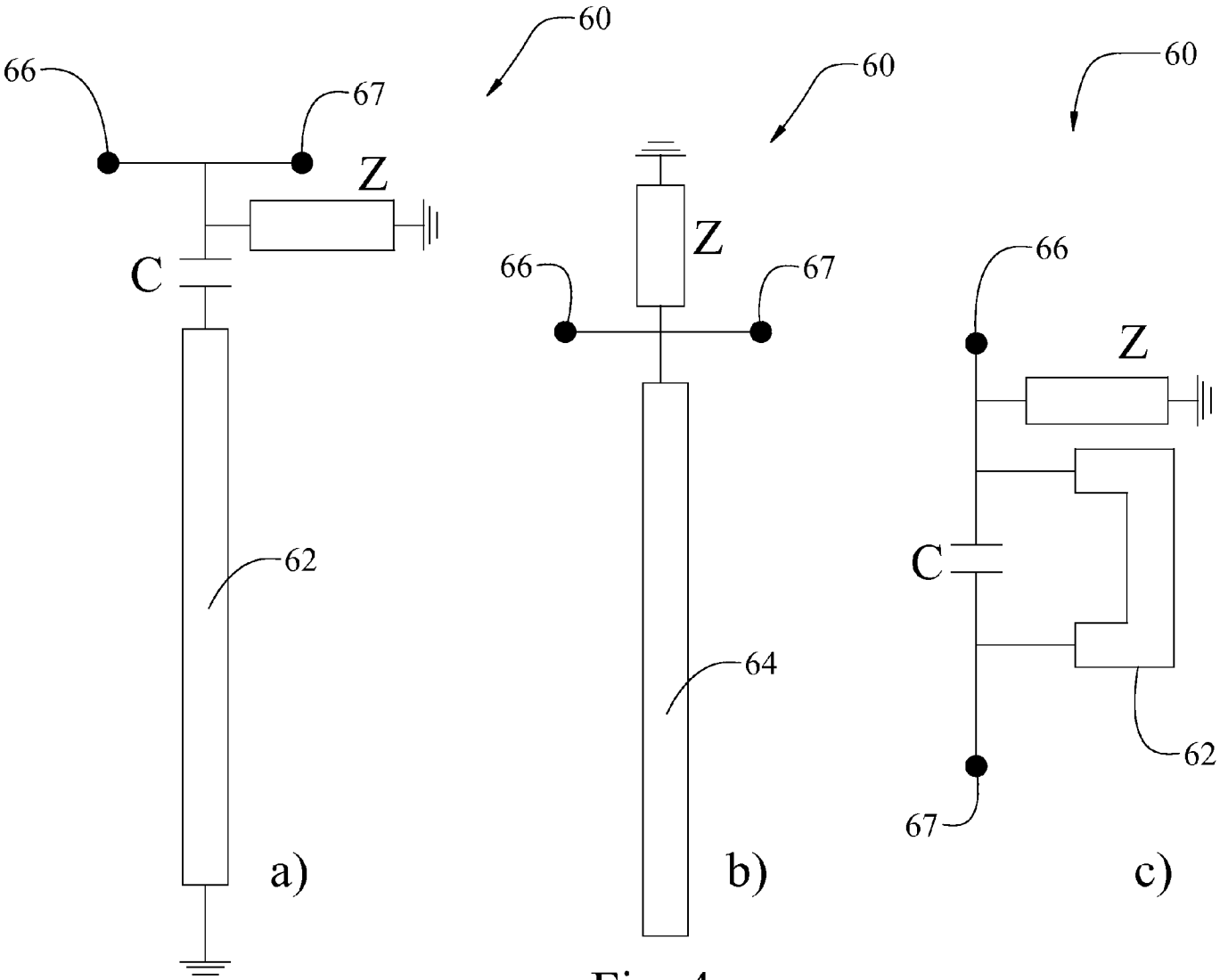

FIG. 3 shows the construction of an antenna module according to a further exemplary embodiment with an additional, substantially vertically oriented antenna for reception of terrestrial signals; and FIGS. 4(*a*) through 4(*c*) illustrate various exemplary embodiments of band-blocking-filters suitable for use with the antenna module shown in FIG. 3 for suppressing the transmission band of the terrestrial antenna.

DETAILED DESCRIPTION

The following description is merely exemplary in nature and is not intended to limit the present disclosure, application, or uses. It should be understood that throughout the drawings, corresponding reference numerals indicate like or corresponding parts and features.

According to various aspects, exemplary embodiments are provided of antenna modules for frequencies in the GHz range and that may be mountable on a motor vehicle. In exemplary embodiments, an antenna module is provided that allows for a compact construction and versatile range of functions with high reliability.

In various exemplary embodiments, an antenna module generally includes two λ/2-patch-antennas of differing size (e.g., having different lengths and/or widths) that are placed or stacked one on top of the other and connected separately. In some embodiments, the upper patch-antenna may have a length less than the length of the lower patch-antenna. Or, for example, the upper patch-antenna may have a width less than the width of the lower patch-antenna. In yet other embodiments, the upper patch-antenna may have a length and a width that are less than the corresponding length and width of the lower patch-antenna. The upper and lower patch-antennas may have different overall thicknesses, or they may have about equal thicknesses.

The upper and lower patch-antennas include their own separate substrate materials, on the respective upper surfaces of which the appropriate λ/2 antenna structures are provided. To provide effective radiation patterns in these embodiments, the lower λ/2 antenna structure is preferably sized dimensionally larger with a greater length and/or greater width than the corresponding dimension of the upper λ/2 antenna structure. In some embodiments, the upper λ/2 antenna structure may have a length less than the length of the lower λ/2 antenna structure. Or, for example, the upper λ/2 antenna structure may have a width less than the width of the lower λ/2 antenna structure. In yet other embodiments, the upper λ/2 antenna structure may have a length and a width that are less than the corresponding length and width of the lower λ/2 antenna structure. The upper and lower λ/2 antenna structure may have the same thickness (e.g., FIG. 1, FIG. 2, FIG. 3, etc.), or they may have different thicknesses.

In various embodiments, the lower surfaces of the upper and lower substrates are metallized, include metallization elements, and/or abut or contact metallization elements. In this exemplary manner, it is axiomatic that both substrates may include metallization of their lower surfaces. In some exemplary embodiments, an additional dielectric material, for example, may in principle be present between the lower metallization of the upper patch-antenna and the antenna structure of the lower patch-antenna.

In accordance with an advantageous or preferred exemplary embodiment, the lower surface of the upper substrate does not include metallization, given that (owing to the layered construction) the lower surface of the upper substrate rests on or is provided directly on the metallic antenna structure of the lower patch-antenna, which thus serves as its own metallization. The inventors hereof have realized that this entails no functional disadvantages, and in particular, no coupling or connecting of the antennas is provided in this instance.

The patch-antennas arranged one-over-the-other are isolated/decoupled. In various embodiments, this is accomplished by having both metallizations of the patch-antennas provided as separate components. That is, the lower metallization of the lower patch-antenna and the metallization of the upper patch-antenna (and/or the operative antenna structure of the lower patch-antenna that serves as the metallization) are provided as separate components.

This is unlike the antenna module of EP 0 521 384 A1 in which the antenna module includes upper and lower substrates having upper surfaces on both of which is present λ/2-antenna structure. Notably, a metal layer present beneath the lower substrate serves as the reference plane for both λ/2-antenna structures, thus facilitating a parallel connection of the oscillating circuits of both antennas. In some exemplary embodiments of the present invention, however, the focus is less on the creation of a broadband system than on the creation of a configuration of two isolated antennas.

In comparison to antenna modules equipped with λ/4 antenna elements for reception of terrestrial signals, exemplary embodiments of the antenna module disclosed herein include λ/2-antenna elements and antenna structures. They are hereby configured for satellite reception; that is, signals with circular polarization below an elevation angle of about thirty degrees to about ninety degrees relative to the horizon. In contrast to conventional antenna structures in which parasitic elements, when present, are provided above the base structure of the antenna and are which are directly coupled to the lower antenna structure, exemplary embodiments of the antenna module disclosed herein include a separate cable connection for the separate upper λ/2-antenna structure.

The signals are preferably conducted via a coaxial cable connection. The preferable coaxial cable connection may be provided on the lower metallization of the lower patch-antenna, or it may be provided on a printed circuit board present in this area. In other embodiments, however, the signals may be conducted via single wire connections. To achieve the same reference potential for the metallizations of the two patch-antennas, exemplary embodiments may include an interlayer connection running through the lower patch-antenna. The interlayer connection may provide a galvanic connection between the two metallizations or between the antenna structure of the lower patch-antenna serving as a metallization of the upper patch-antenna and the metallization of the lower patch-antenna. This interlayer connection may preferably be provided in the middle of the λ/2-antenna structure, since it is at that location or point that the maximum current distribution and correspondingly minimum voltage is present. Therefore, the lateral middle portion of the λ/2-antenna structure may be short-circuited without compromising the current distribution and field distribution. In alternative embodiments, the upper patch-antenna may share the same common ground plane with the lower patch-antenna without an interlayer galvanic connection therebetween. In such alternative embodiments, a signal from the upper patch-antenna will carry through the lower substrate. Accordingly, signals may thus be conducted via a single wire instead of a coaxial line in these alternative embodiments.

Embodiments of the antenna module may be used in a wide range of applications, for example, for receiving GPS signals in L-band, that is, at 1,575 MHz, and satellite digital radio services DAB WorldStar (WorldSpace) in Africa and Asia at 1,467 MHz to 1,492 MHz as well as DMB (Digital Multimedia Broadcasting) in the Far East-Asia at 2,630 MHz to 2,655 MHz, and SDARS (Satellite Digital Audio Reception System) at 2,320 MHz to 2,345 MHz in the United States of America. The range of frequency bands may be selected for the upper and lower patch-antennas by adjusting the length and/or width dimensions of the antenna structures. Furthermore, the dielectric material of a substrate may be changed accordingly to achieve the proper frequency bands. As a result, the upper patch-antenna with the smaller length and/or width may be made to cover the smaller frequencies, if the upper substrate is provided with a correspondingly higher dielectric constant than that of the lower substrate.

In addition to receiving satellite signals, a patch-antenna may also be configured to receive terrestrial signals. For example, the lower patch-antenna may be employed to receive terrestrial SDARS signals. In an advantageous configuration, the upper patch-antenna is employed for GPS reception.

In an advantageous exemplary embodiment of the present invention, active patch-reception antennas are provided, whereby a low-noise amplifier (LNA) is integrated at the base of the antenna. Advantageously, the low-noise amplifiers may be provided on the lower surface of a printed circuit board, on the upper surface of which the lower patch-antenna is provided. Furthermore, one or more low-noise amplifiers may be provided on one printed circuit board, while another low-noise amplifier is provided on a separate printed circuit board. Furthermore, only portions of a low-noise amplifier may be present on a separate printed circuit board in some exemplary embodiments. In such embodiments, the separate portion of the low-noise amplifier preferably contains the DC power supply and/or control, thereby allowing the connection of both printed circuit boards to be realized through a simple wire connection, e.g. a wire pin.

In some exemplary embodiments, an antenna module may also include a terrestrial antenna (e.g., a multiband monopole antenna or a multiband rod antenna, etc.) for reception of telephone signals, AM/FM or terrestrial DAB in L-Band (1452 MHz to 1492 MHz) as well as Band III (170 MHz to 230 MHz). In such embodiments, the terrestrial antenna may be situated in front of, behind, or on the patch-antenna stack, preferably aft thereto in the direction of normal travel of the mobile platform (e.g., motor vehicle, etc.) to which the antenna module is mounted.

If both patch-antennas are combined with a telephone antenna, it may be advantageous to include amplifiers having suitable filter technology for suppressing the relatively strong transmission signal of the telephone antenna at the input of the amplifier. In this exemplary way, the amplifier or the separate amplifiers may be protected from saturation effect.

Furthermore, embodiments of the antenna module may be provided as an antenna array with a plurality of elements from both the upper and lower patch-antennas. The elements in the groups may serve as transmission and/or reception antennas.

In some embodiments, the antenna module may serve as a transmission and reception antenna, with one of the two patch-antennas functioning as the transmission antenna, and the other patch-antenna functioning as the reception antenna. This may be especially useful in an antenna array, in which in each stack one of the two patch-antennas serves as a transmission antenna, while the other serves as a reception antenna.

Figure 1:
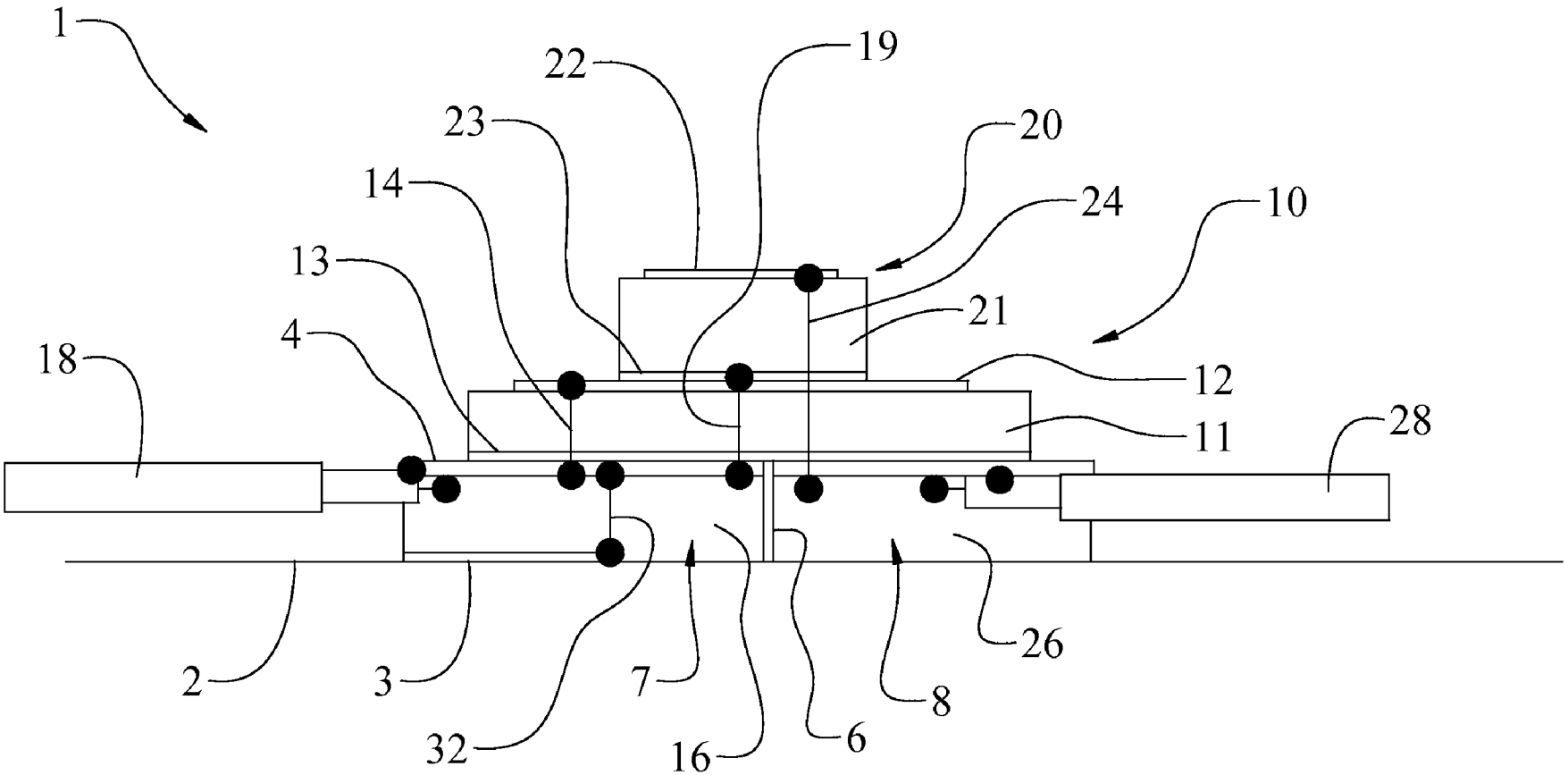
FIG. 1 shows the construction of an antenna module according to a first exemplary embodiment with amplifiers provided on a common printed circuit board.

With reference now to the drawings, and particularly to FIG. 1, an exemplary embodiment is shown of an antenna module 1. As shown in FIG. 1 the antenna module 1 includes a ground plane 2, which may be provided as a metal plate, for example. A lower printed circuit board 3 is disposed on the ground plane 2. An upper printed circuit board 4 is parallel to and above the printed circuit board 3. Between the upper printed circuit board 4 and the ground plane 2 are amplification chambers 7 and 8. The amplification chambers 7 and 8 are laterally separated and electromagnetically shielded by a metallic wall 6. In this illustrated embodiment, the amplification chambers 7 and 8 may constitute parts of a common amplification chamber, which is divided by the metallic wall 6.

With continued reference to FIG. 1, a lower patch-antenna 10 is mounted on the upper printed circuit board 4. The lower patch-antenna 10 includes a lower substrate 11 made of a dielectric material, for example, a ceramic. A lower λ/2-antenna structure 12 is disposed on the upper surface of the lower substrate 11. A lower metallization 13 covers the entire area (or substantially the entire area) of the lower surface of the lower substrate 11. The lower metallization 13 may be provided on the lower surface of the lower substrate 11. Additionally, or alternatively, the lower metallization 13 may include a separate or discrete metallization element abutting against the lower surface of the lower substrate 11. An interlayer connection 14 running or passing through the lower substrate 11 connects the lower λ/2-antenna structure 12 to a low-noise amplifier (LNA) 16. The LNA 16 is present in the left amplification chamber 7, located and/or supported at least partially on the lower surface of the upper printed circuit board 4. The LNA 16 amplifies the received HF-signal and transmits it along the first coaxial cable connector 18. In other embodiments, the LNA 16 may amplify the received HF-signals and transmit it along a single wire connector. The interlayer connection 14 can hereby contact the LNA 16 directly, or preferably indirectly, via a circuit path/printed circuit board track of the upper printed circuit board 4. In some embodiments, the lower patch-antenna 10 may preferably have a radiation pattern covering an elevation angle from about thirty degrees to about ninety degrees.

As illustrated in FIG. 1, the coupling or connecting between the interlayer connection 14 and the lower λ/2-antenna structure 12 is preferably not covered by or vertically disposed directly under an upper λ/2-antenna structure 22. Preferably, this coupling or connecting is also not covered by or vertically disposed directly under an upper substrate 21 either, so that this coupling or connecting may be used as a soldering point without a collision with the upper substrate 21 and the thus required provision of an appropriate recess in the upper substrate 21.

An upper patch-antenna 20 is attached to the lower patch-antenna 10. The upper patch-antenna 20 includes the upper substrate 21, the λ/2-antenna structure 22 disposed on the upper surface of the upper substrate 21, and an upper metallization 23 covering the entire lower surface (or substantially the entire lower surface) of the upper substrate 21. The upper metallization 13 may be provided on the lower surface of the upper substrate 21. Additionally, or alternatively, the upper metallization 23 may include a separate or discrete metallization element abutting against the lower surface of the lower substrate 21. In some embodiments, the lower surface of the upper substrate does not include metallization, given that (owing to the layered construction) the lower surface of the upper substrate rests on or is provided directly on the metallic antenna structure of the lower patch-antenna, which thus serves as its own metallization. The upper λ/2-antenna structure 22 is connected via an upper interlayer connection 24, directly or via the upper printed circuit board 4, to a second low-noise amplifier (LNA) 26. The second LNA 26 is housed in the amplification chamber 8 disposed on and/or at least partially supported by the lower surface of the printed circuit board 4. The second LNA 26 amplifies the received HF-signals, which it transmits to a second coaxial cable connection 28. In other embodiments, the LNA 26 may amplify the received HF-signals and transmit it along a single wire connector. In some embodiments, the upper patch-antenna 20 may preferably have a radiation pattern covering an elevation angle from about thirty degrees to about ninety degrees.

An interlayer connection 19 running through the lower substrate 11 provides a galvanic connection between the lower λ/2-antenna structure 12 and the lower metallization 13, setting these at equal potential. The interlayer connection 19 is provided preferably at the middle of the lower λ/2-antenna structure 12, where no significant voltage, yet maximum current of the induced HF-current, appears.

Portions of the low-noise amplifiers 16, 26 may also be disposed on the printed circuit board 3. The distribution of the amplifiers 16, 26 may be determined solely by the DC current supply, or it may even be configured for an entire or multiple HF-amplifier-levels. Alternatively, both amplifiers 16, 26 may be provided on separate printed circuit boards. If a DC voltage separation is present, a simple wire connection 32 can be provided between the two printed circuit boards 3 and 4 and serve as an electric connection.

In the illustrated embodiment of FIG. 1, the upper patch-antenna 20 with the upper /2-antenna structure 22 is shorter than the lower patch-antenna 10 with the lower λ/2-antenna structure 12. In some embodiments, the upper patch-antenna 20 may have a length less than the length of the lower patch-antenna 10. Or, for example, the upper patch-antenna 20 may have a width less than the width of the lower patch-antenna 10. As yet another example, the upper patch-antenna 20 may have a length and a width less than the corresponding length and width of the lower patch-antenna 10. As disclosed above, this relative sizing allows the coupling or connecting between the interlayer connection 14 and the lower λ/2-antenna structure 12 to be preferably positioned at a location that is not covered by or vertically disposed directly under any portion of the upper patch-antenna 20. This, in turn, allows the coupling or connecting to be used as a soldering point without a collision with the upper substrate 21 and the thus required provision of an appropriate recess in the upper substrate 21.

Continuing with a description of relative sizing, FIG. 1 illustrates the upper λ/2-antenna structure 22 as being shorter than the lower λ/2-antenna structure 12. In some embodiments, the upper λ/2-antenna structure 22 may have a length less than the length of the lower λ/2-antenna structure 12. Or, for example, the upper λ/2-antenna structure 22 may have a width less than the width of the lower λ/2-antenna structure 12. As yet another example, the upper λ/2-antenna structure 22 may have a length and a width less than the corresponding length and width of the lower λ/2-antenna structure 12. By using an upper λ/2-antenna structure 22 having a length and/or width less than the corresponding length and width of the lower λ/2-antenna structure, this relative sizing allows for achievement of good radiation properties of the λ/2-antenna structures 12, 22. In this exemplary configuration, the upper patch-antenna 20 is intended for reception of GPS-signals, while the lower patch-antenna 10 may be employed for SDARS or DAB, for example. Furthermore, the lower patch-antenna 10 may also be employed for the reception of terrestrial signals, such as SDARS, for example. Advantageously, the upper patch-antenna 20 (e.g., having a length and/or width less than that of the lower patch-antenna 10) may be configured (e.g., provided with a upper substrate 21 having a higher dielectric constant than the dielectric constant of the lower substrate 11) for lower frequency bands, and the lower patch-antenna 10 may be configured for higher frequency bands. By adjusting the dielectric constants $\in_r$ accordingly, the frequency bands can be freely set in principle. Therefore, the upper patch-antenna 20 may also be employed for low frequency bands, if the dielectric constant $\in_r$ of the upper substrate 21 is increased accordingly.

According to exemplary embodiments of the present invention, the metallization 23 of the upper patch-antenna 20 may be omitted, thereby allowing the upper surface of the lower λ/2-antenna structure 12 disposed thereunder to operate or function as a metallization.

Figure 2:
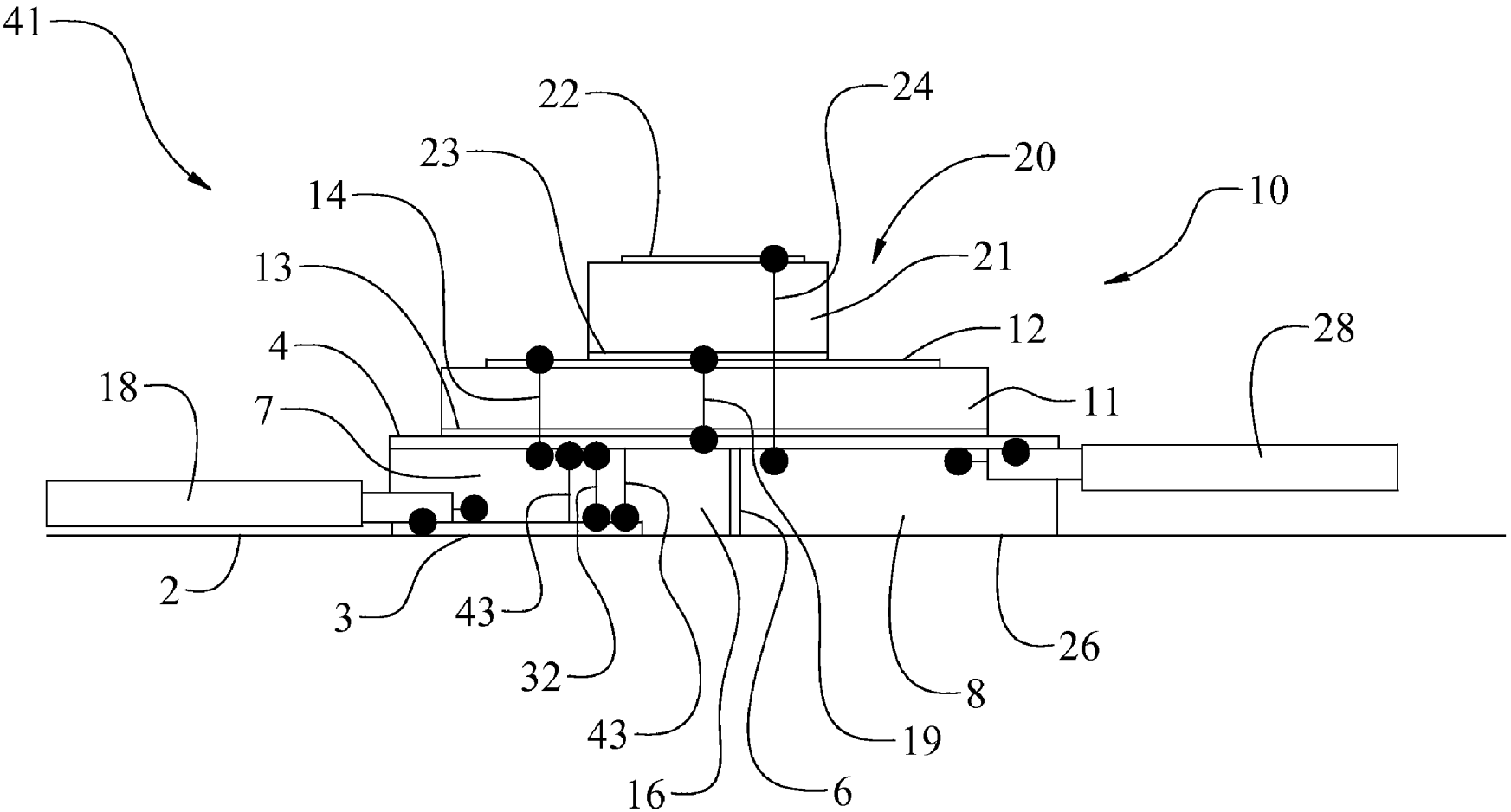
FIG. 2 shows the construction of an antenna module according to a further exemplary embodiment with amplifiers of the antennas elements provided on various printed circuit boards.

FIG. 2 illustrates another exemplary embodiment of an antenna module 41. As shown in FIG. 2, the antenna module 41 has substantially the same construction as that shown in FIG. 1 and is therefore labeled identically. But in this illustration, the first amplifier 1 6 is disposed on the lower printed circuit board 3. As an alternative to this exemplary embodiment, it is preferable if only the HF-portion of the first amplifier 16 is present on the separate, lower printed circuit board 3. In this exemplary manner, the HF-connection between the printed circuit boards 3 and 4 may be provided by a coaxial cable 43, for example. In other embodiments, the HF-connection between the printed circuit boards 3 and 4 may be provided by single wire connectors.

FIG. 3 illustrates another exemplary embodiment of an antenna module 51. As shown in FIG. 3, an antenna 53 is disposed laterally of the antenna module 51. In other embodiments, an antenna 53 may also be disposed laterally of the antenna module 1 (FIG. 1) and/or antenna module 41 (FIG. 2).

With continued reference to FIG. 3, the antenna 53 is configured as a monopole or has a substantially vertical orientation. The antenna 53 may be provided, for example, as a dual or multiband radio antenna, or an AM/FM-radio reception antenna, as well as a terrestrial DAB antenna (L-band or band III), or as a combination of these antennas.

A third amplifier 55 may be housed, for example, in a separate chamber below the antenna 53. The amplifiers 7, 8, and 55 may also share functions.

FIGS. 4(*a*) through 4(*c*) illustrate exemplary embodiments of a band-blocking-filter 60. This filter 60 is preferably configured to sufficiently suppress the transmitting band of the antenna 53, so that no interference (or at least relatively insignificant interference) is generated when radio and digital radio or GPS are operated simultaneously. FIGS. 4(*a*) and 4(*c*) illustrate conductor segment 62 present as an inductor in the band-blocking-filter 60. The conductor segment 62, together with a condenser C, forms a series connection in FIG. 4(*a*), while forming a parallel connection in FIG. 4(*c*). In FIG. 4(*b*), a conducting segment 64 is provided as a λ/4-conductor, which activates an empty-circuit-short-circuit transformation. A blind element Z may be provided according to its intended purpose and may be a condenser, a coil, or a combination of such elements, in an appropriate connection. Each band-blocking-filter 60 is connected to the base of their respective antenna via their input 66. Each band-blocking filter 60 is connected to the input of their respective amplifier via their output 67.

Certain terminology is used herein for purposes of reference only, and thus is not intended to be limiting. For example, terms such as "upper", "lower", "above", "below", "top", "bottom", "upward", and "downward" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An antenna module for frequencies in the GHz range and mountable on a motor vehicle, the antenna module comprising:

a lower patch-antenna including:

a lower substrate including a dielectric material;

a lower λ/2-antenna structure on an upper surface of the lower substrate for reception of satellite transmitted frequencies in the GHz range;

a lower metallization provided on or in contact with a lower surface of the lower substrate;

an upper patch-antenna including:

an upper substrate including a dielectric material;

an upper λ/2-antenna structure on an upper surface of the upper substrate for reception of satellite-transmitted frequencies in the GHz-range, the upper λ/2-antenna structure having a length and a width at least one of which is less than the corresponding dimension of the lower λ/2-antenna structure; and an upper metallization provided on or in contact with a lower surface of the upper substrate;

a lower antenna connector coupled to the lower λ/2-antenna structure and running from the lower λ/2-antenna structure through the lower substrate, the upper patch-antenna having a length and a width at least one of which is less than the corresponding dimension of the lower patch-antenna such that the connecting of the lower antenna connector to the lower λ/2-antenna structure is substantially free from being covered by the upper patch-antenna; and an upper antenna connector separate from the lower antenna connector, and running from the upper λ/2-antenna structure through the upper substrate and the lower patch-antenna.

2. The antenna module of claim 1, further comprising an interlayer connection running through the lower substrate and providing a galvanic connection between the lower λ/2-antenna structure and the lower metallization.

3. The antenna module of claim 2, wherein the interlayer connection galvanically connects a zero-potential area of a middle lateral portion of the lower λ/2-antenna structure to the lower metallization.

4. The antenna module of claim 1, wherein the upper and lower patch-antennas share the same common ground plane without an interlayer galvanic connection therebetween such that a signal from the upper patch-antenna through the lower substrate.

5. The antenna module of claim 1, wherein the upper and lower λ/2-antenna structures have radiation patterns covering an elevation angle from about thirty degrees to about ninety degrees.

6. The antenna module of claim 1, wherein the upper substrate has a higher dielectric constant than the dielectric constant of the lower substrate, and wherein the upper patch-antenna is configured for a lower frequency range than the lower patch-antenna.

7. The antenna module of claim 1, further comprising at least one terrestrial antenna for reception of terrestrial signals, the at least one terrestrial antenna being laterally disposed relative to the upper and lower patch-antennas or mounted to the upper or lower patch-antennas.

8. The antenna module of claim 1, wherein the lower metallization is provided on the lower surface of the lower substrate.

9. The antenna module of claim 1, wherein the lower metallization includes a metallization element abutting against the lower surface of the lower substrate.

10. The antenna module of claim 1, wherein the upper metallization is provided on the lower surface of the upper substrate.

11. The antenna module of claim 1, wherein the upper metallization includes a metallization element abutting against the lower surface of the upper substrate.

12. The antenna module as claimed in claim 1, wherein the upper metallization is the lower λ/2-antenna structure of the lower patch-antenna.

13. The antenna module of claim 1, further comprising at least one amplification chamber below the lower patch-antenna and having an amplifier unit therein connected to one of the upper and lower antenna connectors.

14. The antenna module of claim 1, further comprising first and second amplification chambers below the lower-patch antenna that are electromagnetically shielded by a metallic wall, wherein the first amplification chamber includes a first low-noise amplifier to receive the signals of the lower λ/2-antenna structure via the lower antenna connector, and wherein the second amplification chamber includes a second low-noise amplifier to receive the signals of the upper λ/2-antenna structure via the upper antenna connector.

15. The antenna module of claim 1, further comprising at least one amplification chamber mounted on a ground plane, and wherein the lower metallization is galvanically connected to the ground plane.

16. The antenna module of claim 1, wherein the lower patch-antenna is disposed on a printed circuit board having a lower surface supporting one or more amplifiers.

17. An antenna module for frequencies in the GHz range and mountable on a motor vehicle, the antenna module comprising:

a lower patch-antenna including:

a lower substrate including a dielectric material;

a lower λ/2-antenna structure on an upper surface of the lower substrate for reception of satellite transmitted frequencies in the GHz range;

a lower metallization provided on or in contact with a lower surface of the lower substrate;

an upper patch-antenna sharing the same common ground plane with the lower patch-antenna without an interlayer galvanic connection therebetween, the upper patch-antenna including:

an upper substrate including a dielectric material;

an upper λ/2-antenna structure on an upper surface of the upper substrate for reception of satellite-transmitted frequencies in the GHz-range, the upper λ/2-antenna structure having a length and a width at least one of which is less than the corresponding dimension of the lower λ/2-antenna structure; and an upper metallization provided on or in contact with a lower surface of the upper substrate;

a lower antenna connector coupled to the lower λ/2-antenna structure and running from the lower λ/2-antenna structure through the lower substrate; and an upper antenna connector separate from the lower antenna connector, and running from the upper λ/2-antenna structure through the upper substrate and the lower patch-antenna.

18. The antenna module of claim 17, wherein the upper and lower λ/2-antenna structures have radiation patterns covering an elevation angle from about thirty degrees to about ninety degrees.

19. The antenna module of claim 17, wherein the upper patch-antenna has a length and a width at least one of which is less than the corresponding dimension of the lower patch-antenna such that the connecting of the lower antenna connector to the lower λ/2-antenna structure is substantially free from being covered by the upper patch-antenna.

20. An antenna module for frequencies in the GHz range and mountable on a motor vehicle, the antenna module comprising:

a lower patch-antenna having a radiation pattern covering an elevation angle from about thirty degrees to about ninety degrees, the lower patch-antenna including:

a lower substrate including a dielectric material;

a lower λ/2-antenna structure on an upper surface of the lower substrate for reception of satellite transmitted frequencies in the GHz range;

a lower metallization provided on or in contact with a lower surface of the lower substrate;

an upper patch-antenna having a length and a width at least one of which is less than the corresponding dimension of the lower patch-antenna, the upper patch-antenna having a radiation pattern covering an elevation angle from about thirty degrees to about ninety degrees, the upper patch-antenna including:

an upper substrate including a dielectric material;

an upper λ/2-antenna structure on an upper surface of the upper substrate for reception of satellite-transmitted frequencies in the GHz-range the upper λ/2-antenna structure having a length and a width at least one of which is less than the corresponding dimension of the lower λ/2-antenna structure; and an upper metallization provided on or in contact with a lower surface of the upper substrate;

a lower antenna connector coupled to the lower λ/2-antenna structure and running from the lower λ/2-antenna structure through the lower substrate; and an upper antenna connector separate from the lower antenna connector, and running from the upper λ/2-antenna structure through the upper substrate and the lower patch-antenna.

* * * * *